US007681360B2

(12) United States Patent
Daniels et al.

(10) Patent No.: US 7,681,360 B2
(45) Date of Patent: Mar. 23, 2010

(54) SASH WINDOW ASSEMBLY

(75) Inventors: John Patrick Daniels, Marietta, GA (US); Jin Goto, Marietta, GA (US); Hiroyuki Sasaki, Toyama (JP); Akio Ozawa, Toyama (JP); Tsutomu Ito, Marietta, GA (US)

(73) Assignees: YKK Corporation of America, Marietta, GA (US); YKK AP Inc., Tokyo (JP)

( * ) Notice: Subject to any disclaimer, the term of this patent is extended or adjusted under 35 U.S.C. 154(b) by 1109 days.

(21) Appl. No.: 11/328,576

(22) Filed: Jan. 10, 2006

(65) Prior Publication Data

US 2007/0157520 A1 Jul. 12, 2007

(51) Int. Cl.
*E05D 15/26* (2006.01)

(52) U.S. Cl. ..... 49/125; 49/63; 49/61

(58) Field of Classification Search ..... 49/61, 49/63, 67, 125, 161, 163, 176, 183, 184, 49/185, 440, 449, 504, 380; 52/204.5, 204.51, 52/204.53, 211

See application file for complete search history.

(56) References Cited

U.S. PATENT DOCUMENTS 1,107,580 A * 8/1914 Brandt ..... 49/184
2,023,753 A * 12/1935 Triller ..... 49/381
2,842,235 A * 7/1958 Stalle ..... 49/406
3,757,473 A * 9/1973 Mundy ..... 49/380
4,222,200 A * 9/1980 Beirnes ..... 49/63
4,407,100 A * 10/1983 Huelsekopf ..... 52/204.54
4,691,477 A * 9/1987 Governale ..... 49/380
4,958,468 A * 9/1990 Nolan ..... 52/204.51
4,982,530 A * 1/1991 Palmer ..... 49/504
5,603,585 A * 2/1997 Bruchu et al. ..... 403/382
5,657,579 A * 8/1997 Bruchu et al. ..... 49/161
6,067,754 A * 5/2000 Bellart ..... 49/453
6,076,314 A * 6/2000 Simonton et al. ..... 52/204.1
6,662,512 B2 * 12/2003 Westphal ..... 52/204.5
6,826,871 B2 12/2004 Morton et al.
2006/0225362 A1 * 10/2006 Pettit et al. ..... 49/445

* cited by examiner

*Primary Examiner*—Gregory J. Strimbu
(74) *Attorney, Agent, or Firm*—Alston & Bird, LLP

(57) ABSTRACT

A sash window includes two window frames disposed in lateral juxtaposition and each including a head member, a sill member and a pair of jamb members connected together into a rectangular configuration, and a pair of upper and lower sashes supported within a respective one of the window frames. A sill nose is mounted to exterior sides of the sill members and extends continuously from an outer end of one sill member to an outer end of the other sill member. Each of the upper sashes is fixed to the respective one of the window frames by attachment members.

11 Claims, 11 Drawing Sheets

SASH WINDOW ASSEMBLY

BACKGROUND OF THE INVENTION

1. Field of the Invention

The present invention relates generally to sash windows, and more particularly to a single-hung or double-hung window having at least two sashes supported in vertical juxtaposition within a window frame.

2. Description of Related Art

Sash windows adapted to be mounted in an opening in the exterior wall of a commercial or residential building are known as single- or double-hung windows having a pair of upper and lower sashes. A typical example of such known sash windows is described in U.S. Pat. No. 6,826,871 B2 which comprises a window frame including a head member, a sill member and a pair of jamb members connected together into a rectangular configuration, and a pair of sashes each having a sash frame including a top rail, a bottom rail and a pair of side rails connected together into a rectangular configuration, and a panel member of glass disposed within the sash frame. The window frame members and the sash frame members are formed from an elongated strip of extruded highly rigid plastic such as PVC (polyvinyl chloride). Four such elongated strips are assembled together into a rectangular frame by welding together mating ends thereof.

In many cases, joining between the head member and each jamb member is accomplished by first cutting an end of each of the head and jamb members at an angle of 45 degrees relative to a longitudinal axis of the head or jamb member and subsequently welding together the cut or beveled ends of the head and jamb members to form a miter joint. With this joining structure, since the beveled mating ends of the head and jamb members being welded together have a common cross-sectional shape, a sufficiently large structural strength can be obtained.

On the other hand, joining between the sill member and each jamb member is accomplished by first cutting an end of the jamb member at right angles to the longitudinal axis of the jamb member and subsequently welding the cut end of the jamb member to an upper surface of the sill member to form an end-butt joint. This joining structure is employed mainly for a reason that a sill member arranged to extend over the entire width of the window frame is preferred from an aesthetic viewpoint as compared to a sill member miter-joined with each jamb member in the same manner as the head member. The end-butt joint used for joining each jamb member to the sill member cannot provide a strength comparable to that of the miter joint formed between the head member and each jamb member, however, the miter joint when used as a joint between the sill member and each jamb member would reduce the commercial value of a finished sash window due to its less preferable appearance.

SUMMARY OF THE INVENTION

A significant advantage of the present invention is to provide a sash window which is highly satisfactory in terms of the strength and aesthetic appearance.

In an embodiment of the invention, there is provided a sash window comprising a window frame including a head member, a sill member and a pair of jamb members connected together into a rectangular configuration; at least one sash having a sash frame including a top rail, a bottom rail and a pair of side rails connected together into a rectangular configuration, and a panel member disposed within the sash frame; and a facing member covering an exterior side of the sill member and extending horizontally between opposite side ends of the window frame.

Preferably, a joint between the sill member and each of the jamb members at least partly includes a miter joint, and the facing member covers at least part of the miter joint.

In one preferred form of the invention, the window frame comprises a plurality of window frames disposed in horizontal juxtaposition with each other, and the facing member is configured to extend continuously over the entire width of the horizontally juxtaposed window frames.

The facing member, which is exposed to view at the exterior side of the sill member, is a separate part structurally independent from the sill member. It is therefore possible to cover a joint between the sill member and each jamb member even when the joint takes the form of a miter joint. Thus, both advantageous strength and advantageous aesthetic appearance can be provided concurrently. Furthermore, even when the sash window includes two or more window frames disposed in horizontal juxtaposition, only a single facing member may be used by properly selecting a length thereof. This adds to an aesthetic value of the sash window. The facing member may be replaced by another facing member with a different design and/or projecting length. It is therefore possible to enjoy various different design patterns for each individual window frame by changing the facing member.

Preferably, the facing member is attached to the sill member via at least two tongue-and-groove fitting structures.

It is preferable that outermost two jamb members which are disposed at opposite side ends of the horizontally juxtaposed window frames and remaining jamb members which are disposed in pairs at respective adjoining areas of the horizontally juxtaposed window frames are substantially identical in structure, and the remaining jamb members in each pair are connected together back to back via a joint. This arrangement eliminates the need for provision of a separate jamb member such as a mullion at each adjoining area of the horizontally juxtaposed window frames.

Preferably, at least one of the head member, the sill member and the pair of jamb members includes a first attachment portion adapted to attach the window frame to a building wall in a depth direction of the sash window, and a second attachment portion adapted to attach the widow frame to the building wall in a width direction of the sash window. The first attachment portion and the second attachment portion are used selectively. Because of the first and second attachment portions, it is no longer necessary to provide two different types of frame members, one being designed exclusively for attachment in the depth direction and the other being designed exclusively for attachment in the width direction.

The head member, the sill and the pair of jamb members are adapted to be supported on a head support portion, a sill support portion, and a pair of jamb support portions, respectively, of a building. Preferably, at least one of the head member, the sill and the pair of jamb members includes a base member adapted to be secured to a corresponding one of the support portions, and a frame body connected to the base member and covering the base member.

In one preferred form of the invention, the base member is adapted to be secured to the corresponding support member by one of nailing, screw clamping, adhesive bonding, pressure-sensitive adhesion, welding and a combination thereof, and the frame body and the base member are detachably connected together via a tongue-and-groove fitting structure. Since the base member is covered by the frame body, it is possible to freely select a suitable securing method among those specified above for the attachment of the base portion to the support portion of the building. This ensures that the base member can be firmly secured to the support portion without deteriorating the appearance of the window frame as a whole.

The at least one sash may comprise a plurality of sashes in which instance at least one of the plurality of sashes is a movable sash slidably movable either along the head and sill members or along the pair of jamb members, and a lock device is provided on one of the top, bottom and side rails of the movable sash for locking the movable sash in position against movement relative to another sash or the window frame. The window frame has a recessed portion formed at a portion thereof facing the lock device and accommodating the lock device when the movable sash is in a fully open position. With this arrangement, since the lock device does not interfere with the window frame when the movable window is in its fully open position, it is possible to maximize the area of an opening provided when the movable sash is fully opened.

In one preferred form of the invention, the least one sash comprises a plurality of sashes and at least one of the plurality of sashes is a fixed sash in which instance a pair of attachment members are disposed at opposite lower corner portions of the fixed sash firmly securing the fixed sash to the window frame. Each of the attachment members includes a generally rectangular body having one surface facing a respective one of the jamb members, a retaining portion for retaining a part of the fixed sash, a through-hole extending diagonally from a side opposite to the retaining portion to the one surface of the body, and an attachment screw received in the through-hole and threaded into the jamb member.

Preferably, the through-hole is a stepped hole including a small-diameter portion having an inside diameter having a size to allow passage of a shank of the attachment screw but block passage of a head of the attachment screw, and a large-diameter portion having an inside diameter having a size to accommodate therein the attachment screw including the head, the large-diameter portion including a retainer projection projecting from a circumferential surface of the large-diameter portion in interlocking engagement with the head of the attachment screw to retain the attachment screw within the through-hole.

By using the attachment member, the screw-tightening operation can be effected from a diagonal direction, which provides a larger space for manipulation of a tool such as screwdriver and hence is higher in efficiency than the conventional operation effected in a horizontal direction. Furthermore, since the attachment screw is accommodated in advance within the attachment member and kept free from removal or omission, the sash mounting operation can be achieved with high efficiencies. Additionally, since the upper sash is firmly secured to the window frame via the attachment members, it is possible to prevent objectionable spreading or deformation which may otherwise occur during transportation or construction. Embodiments of the present invention may have various features or aspects and provide various advantages. Any of the features, aspects and advantages of the present invention may be desired, but, are not necessarily required to practice the present invention.

BRIEF DESCRIPTION OF THE DRAWINGS

A preferred structural embodiment of the present invention will be described in detail herein below, by way of example only, with reference to the accompanying sheets of drawings, in which.

DETAILED DESCRIPTION OF THE PREFERRED EMBODIMENT

The general arrangement of a single-hung window 1 constituting a sash window according to an embodiment of the present invention will be described below in greater detail with reference to FIGS. 1 to 4.

Figure 1:
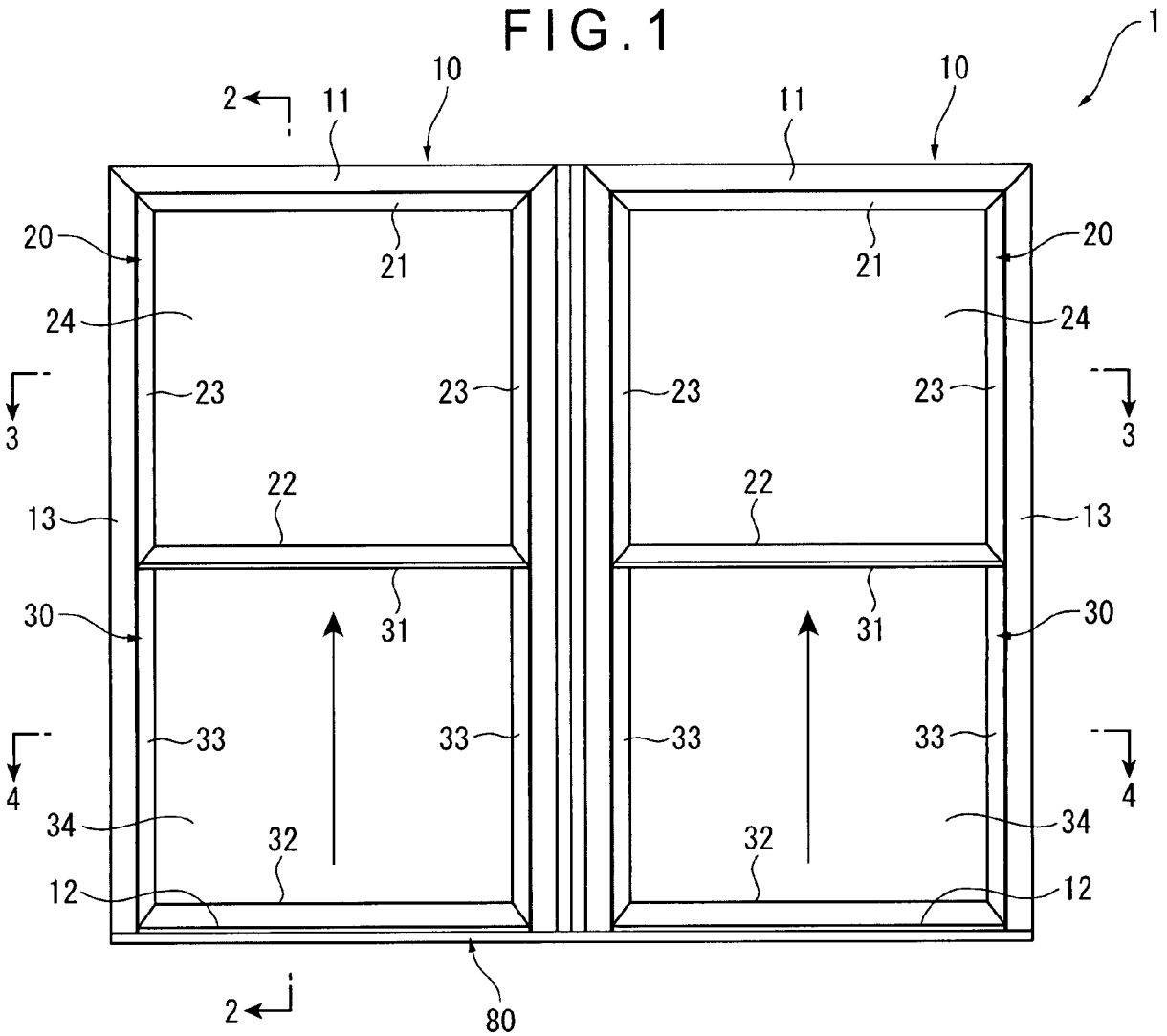
FIG. 1 is a front elevational view of a sash window according to an embodiment of the present invention looking from an exterior side of the sash window.

As shown in FIG. 1, the single-hung window 1 comprises a so-called "dual-type" single-hung window, which is installed in an opening in the exterior wall of a building, such as a house, for separating an interior space and an exterior space of the building. The dual-type single-hung window 1 has two window frames 10 disposed side by side or in horizontal juxtaposition with an upper sash 20 and a lower sash 30 supported within each of the window frames 10. The window frames 10 each include a head member 11, a sill member 12 and a pair of side or jamb members 13, 13 connected together into a rectangular shape. The upper and lower sashes 20 and 30 each have a sash frame including a top rail 21, 31, a bottom rail 22, 32, and a pair of side rails or stiles 23, 33 connected together into a rectangular shape, and a panel of glazing (double-glazing) 24, 34 held within the sash frame.

Figure 2:
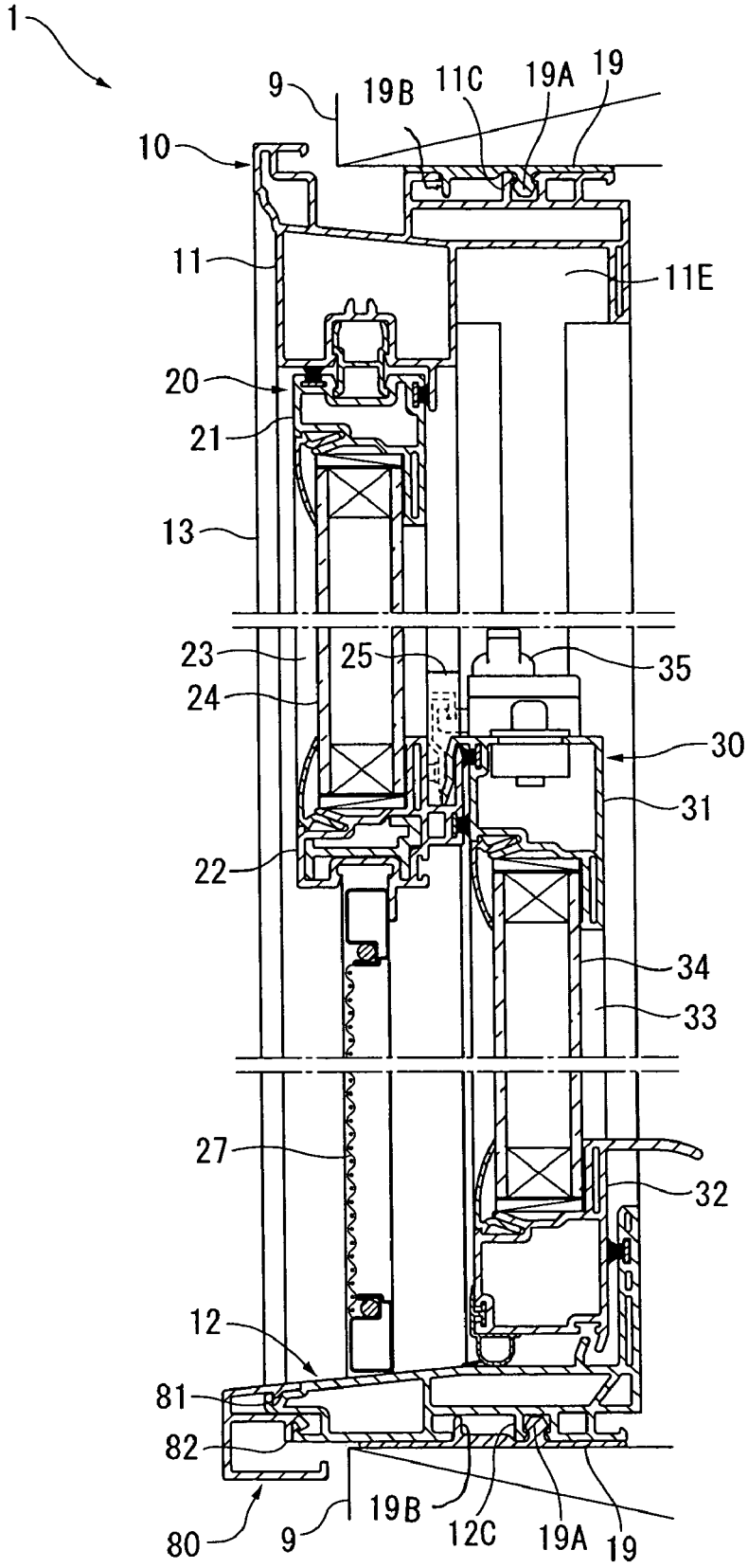
FIG. 2 is a cross-sectional view taken along line 2-2 of FIG. 1.
Figure 3:
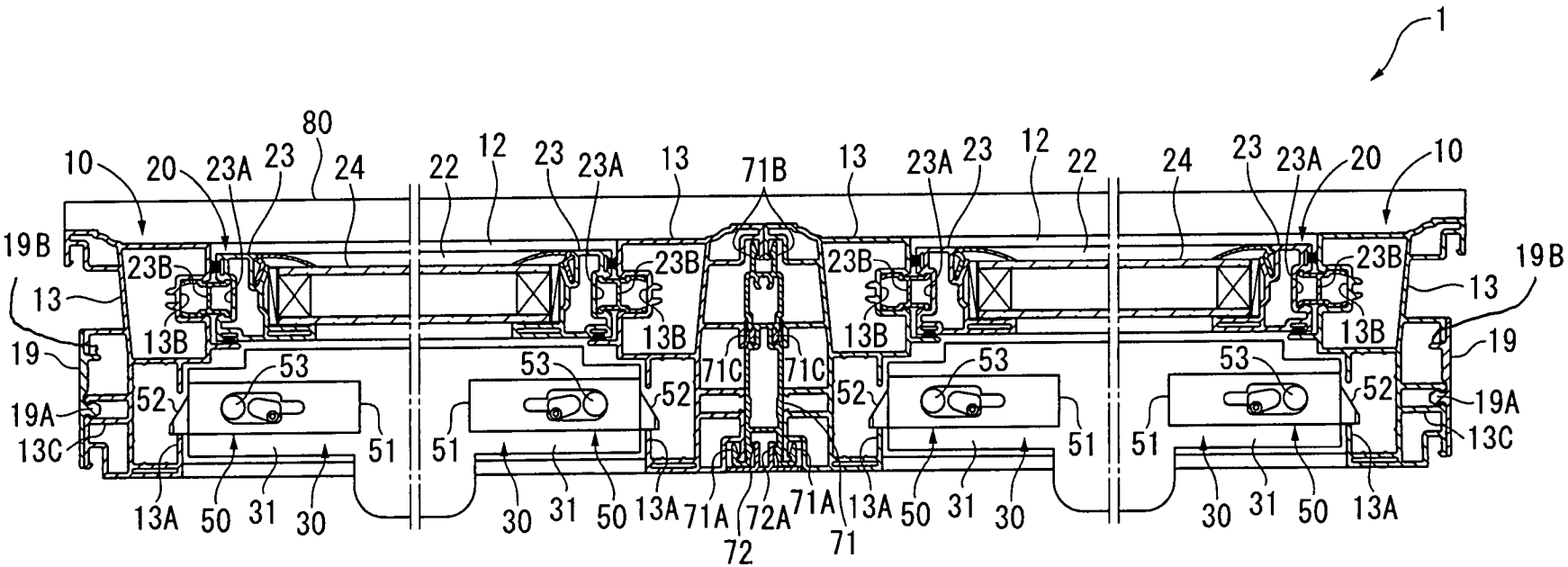
FIG. 3 is a cross-sectional view taken along line 3-3 of FIG. 1.
Figure 4:
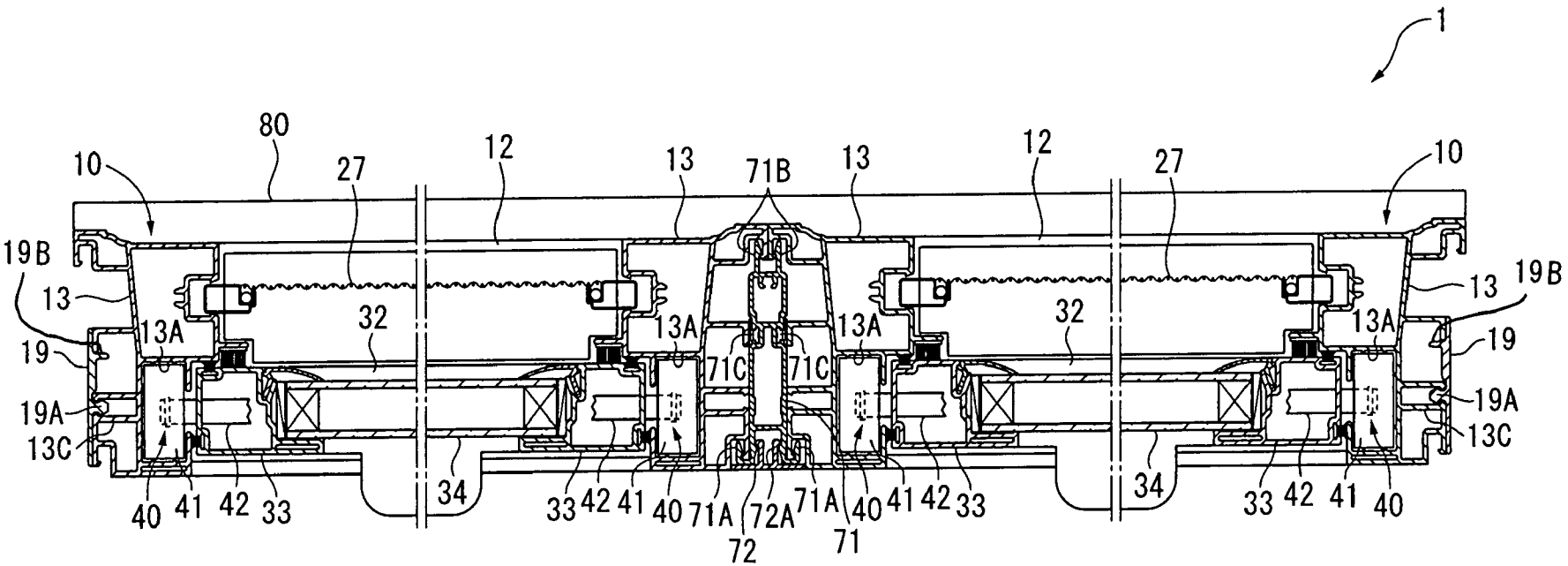
FIG. 4 is a cross-sectional view taken along line 4-4 of FIG. 1.

As shown in FIGS. 2-4, the upper sashes 20 and the lower sashes 30 are offset from each other in a depth direction of the window 1 (i.e., in a direction perpendicular to a general plane of the window 1) with the upper sashes 20 disposed on an exterior side of the sash window 1 and with the lower washes 30 disposed on an interior side of the window 1.

In the illustrated embodiment, each of the lower sashes 30 is supported and guided by the jamb members 13, 13 of respective one of the window frames 10 for vertical sliding movement along the jamb members 13 to open and close the window 1, whereas each of the upper sashes 20 is fixed while being positioned by the head member 11 and the jamb members 13 of respective one of the window frames 10 (single-hung type). Each of the upper sashes 20 and a mating one of the lower sashes 30 may be guidedly supported by the jamb members 13, 13 of respective one of the window frames 10 for vertical sliding movement along the jamb members 13 to open and close the window 1 (double-hung type).

The window 1 further includes a movable or fixed wire screen 27 disposed within each window frame 10 at an exterior side thereof. The screen 27 may be omitted as appropriate. The window 1 may further include a fixed or drawable blind disposed on the interior side of each window frame.

The single-hung window 1 is in a fully closed state when the lower sashes 20 are in a lower limit position of vertical movement. In this state, the bottom rail (outer meeting rail) 22 of each upper sash 20 and the top rail (inner meeting rail) 31 of a mating one of the lower sashes 30 are overlapped in the depth direction of the window 1. The top rail 31 of the lower sash 30 has a crescent lock 35, and the bottom rail 22 of the upper sash 20 has a crescent keeper 25 so that when the crescent lock 35 is engaged with the crescent keeper 25 with the upper and lower sashes 20 and 30 placed in a closed state, the single-hung window 1 in the fully closed state is locked in position.

As shown in FIG. 3, the upper sashes 20 are located on the exterior sides of the respective window frames 10 and fixed in position. Each of the side rails 23 of respective one of the upper sashes 20 has a longitudinal recessed portion 23A extending over the entire length thereof, and each of the jamb members 13 of respective one of the window frames 10 has a longitudinal recessed portion 13B extending over the entire length thereof and aligned with the recessed portion 23A in the adjacent side rail 23 in a width direction of the window 1 (i.e., in a direction parallel to the general plane of the window 1). An elongated joint 23B of H-shaped cross section is fitted between the recessed portion 23A of the side rail 23 and the recessed portion 13B of the jamb member 13 so as to provide a fluid-tight seal (or weatherstrip) between the side rail 23 and the jamb member 13. The H-shaped joint 23B is an extruded article of soft synthetic resin material or elastomeric material such as rubber. The joint 23B may be arranged to extend continuously over the entire length of the side rail 23. As an alternative, the joint 23B may be arranged at intervals along the length of the side rail 23.

As shown in FIGS. 3 and 4, the lower sashes 30 are located on the interior sides of the respective window frames 10. Each of the lower sashes 30 includes a pair of support devices 40 (FIG. 4) disposed on lower end portions at opposite sides thereof, and a pair of latch devices 50 (FIG. 3) on upper end portions at opposite sides thereof. The support devices 40 and the latch devices 50 are guided by the jamb members 13 of each window frame 10 so that the lower sash 30 is vertically slidable within the window frame 10.

As shown in FIG. 4, each of the support devices 40 includes a block-like slide shoe 41 and a pin 42 connecting the slide shoe 41 to the lower sash 30. The pin 42 serves as a pivot shaft as will be described later. The slide shoe 41 is held within a guide rail or track 13A formed in each jamb member 13 and slidable in a vertical direction along the jamb member 13. The slide shoe 41 is connected to a load bearing mechanism (not shown) for supporting a weight of the lower sash 30. The load bearing mechanism may be a conventional structure used as appropriate, for example, a structure including a counterweight or balancer connected via a wire, a structure including a helical spring for supporting the load, or the like.

As shown in FIG. 3, each of the latch devices 50 includes a box-like case 51, a latch bolt 52 retractably held in the case 51 with one end portion (front end portion) thereof projecting from an end of the case 51, and a compression coil spring (not shown) disposed in the case 51 for urging the latch bolt 52 in a direction projecting outward from the case 51. The case 51 has an opening formed in an upper wall thereof so that the latch bolt 52 is partially exposed to view through the opening. Thus, by manually operating an exposed part 53 of the latch bolt 52, the latch bolt 52 can move in a direction to compress the coil spring. The case 51 is held inside opposite end portions of the top rail 31, and the front end portion of the latch bolt 52 is normally disposed in an operating position in which the front latch bolt end projects outward from an upper end portion of each side rail 33. The projecting front end portion of the latch bolt 52 is slidable in a vertical direction along the track 13A in each jamb member 13 of respective one of the window frames 10.

Each of the lower sashes 30 is vertically slidable with the support devices 40 and the latch devices 50 guidedly received in the tracks 13A of the jamb members 13 of respective one of the window frames 10. Furthermore, when the latch devices 50 on each lower sash 30 are manually operated to disengage from the jamb members 13, the lower sash 30 becomes pivotable inwardly as the pins 42 of the support devices 40 serve as pivot shafts on the lower sash 30. In order to limit pivotal movement of the lower sash 30 in an inward direction of the window 1, each of the side rails 33 of respective one of the lower sashes 30 and a corresponding one of the jamb members 13 of each window frame 10 are connected together by an arm (not shown).

By tilting the lower sash 30, an outside surface of the lower sash 30 can be cleaned from the room interior side of the window 1. In general, the foregoing pivot operation is applied only to the lower sash 30 for enabling cleaning of the outside surface of the lower sash 30. This is because an outside surface of each upper sash 20 is readily accessible for cleaning when a corresponding one of the lower sashes 30 is in the open state. However, the upper sashes 20 may be configured to become pivotable.

In the illustrated embodiment, the head, sill and jamb members 11, 12 and 13 of the window frames 10 and the top rails 21, 31, bottom rails 22, 32 and side rails 23, 33 of the upper and lower sashes 20, 30 are extrusion molded from synthetic resin into elongated members of particular cross-sectional shapes or profiles shown in the drawing figures, the elongated members being subsequently assembled together into rectangular frames. The synthetic resin material may include polyvinyl chloride (PVC). The material for the window frames 10 and sashes 20, 30 should not be limited to the synthetic material but may include wood, metal such as aluminum alloy, or a combination of these materials.

As described above, the single-hung window 1 is of the dual-type in which two window frames 10 are disposed side by side or in horizontal juxtaposition. The head and sill members 11 and 12 of each window frame 10 are firmly secured to upper and lower support portions 9, respectively, at a window opening of a building frame. Outermost two jamb members 13 that are located at opposite side ends of the window 1 are also firmly secured to side support portions 9 at the window opening of the building frame. Each of the head member 11, sill member 12 and outermost jamb members 13 is secured to respective one of the support portions 9 via a base member 19. In terms of the attachment of each window frame member 11, 12, 13 to the corresponding support portion 9, the base member 19 forms a part of the window frame member 11, 12, 13, and the window frame member 11, 12, 13 itself forms a body of the window frame member.

In FIG. 2 the base member 19 is secured to the support portion 9 on which the sill member 12 is supported. For this securement or fixing, a conventional securing method, such as nailing, screw clamping, caulking, adhesion bonding, pressure-sensitive adhesion, welding or a combination thereof may be used as appropriate. The base member 19 is eventually covered or concealed by the sill member 12, so that selection of a desired securing method can be achieved freely without any regard for the appearance of the base member 19 after fixing.

The base member 19 comprises an extruded article of synthetic resin or aluminum alloy and includes an elongated plate-like body having a joining projection 19A and an auxiliary projection 19B formed on one surface of the plate-like body and extending on and along a central portion thereof over the entire length of the plate-like body. An area of the base member 19, which is defined between the joining and auxiliary projections 19A and 19B, is made thicker than neighboring areas of the base member 19. The sill member 12 has on its under side a longitudinal groove 12C in which the joining projection 19A of the base member 19 is fitted.

By using the base member 19, the sill member 12 is attached to the support portion 9 of the building frame in a manner as described below. At first, the base member 19 is firmly secured to an accurate position on the support portion 9. Subsequently, the sill member 12 is placed above the base member 19 with the groove 12C held in vertical alignment with the joining projection 19A of the base member 19. Thereafter, the sill member 12 is forced downward so that the joining projection 19A fits into the groove 12C to thereby join the sill member 12 and the base member 19. The sill member 12 is now fixed at an accurate position on the support member 9 via the base member 19. The foregoing sill attachment work or process is simple and does not involve deterioration of the appearance because the fixing means are not exposed to view.

The foregoing description pertains to the attachment of the sill member 12 to the support portion 9 of the building frame. In the illustrated embodiment, however, the same attachment structure using the base member 19 is also applied to the head member 11 having a groove 11C and the outermost two jamb members 13.

Figure 5:
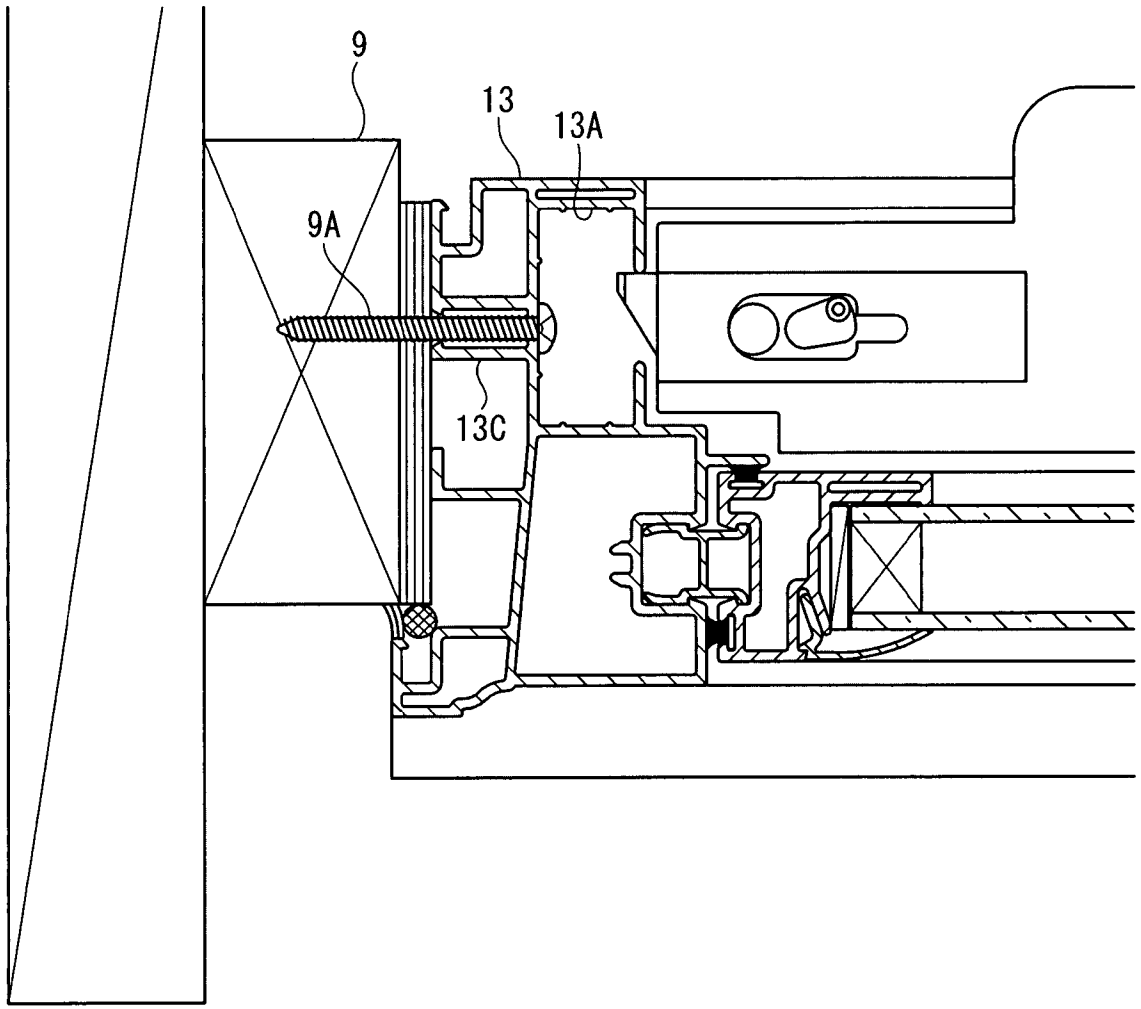
FIG. 5 is a cross-sectional view illustrative of the manner in which a jamb member of the sash window is attached in a width direction of the sash window.

The foregoing attachment structure involving the use of a base member 19 may be replaced by other attachment structures as will be discussed below. As shown in FIG. 5, a jamb member 13 (which is identical to the jam member 13 shown in FIGS. 3 and 4) is secured by screws 9A (only one shown) to a support portion 9 without using a base member 19 (see FIGS. 3 and 4). The screw 9A is arranged to extend through a longitudinal recessed portion or groove 13C of the jamb member 13 in the width direction of the window, the groove 13C corresponding to the groove 12C of the sill member 12 and being provided for fitting engagement with a projection 19A of a base member 19 when used. The jamb member 13 has a through-hole formed in a bottom wall of the groove 13C for the passage therethrough of a shank of the screw 9A, and an access through-hole formed in a bottom wall of the track 13A for permitting access to the screw 9A for tightening and loosening the same. In the illustrated attachment structure, an outer sidewall of the jamb member 13, which faces the support portion 9 and has the groove 13C, form an attachment portion of the jamb member in the width direction of the window relative to the support portion 9 of the building.

Figure 6:
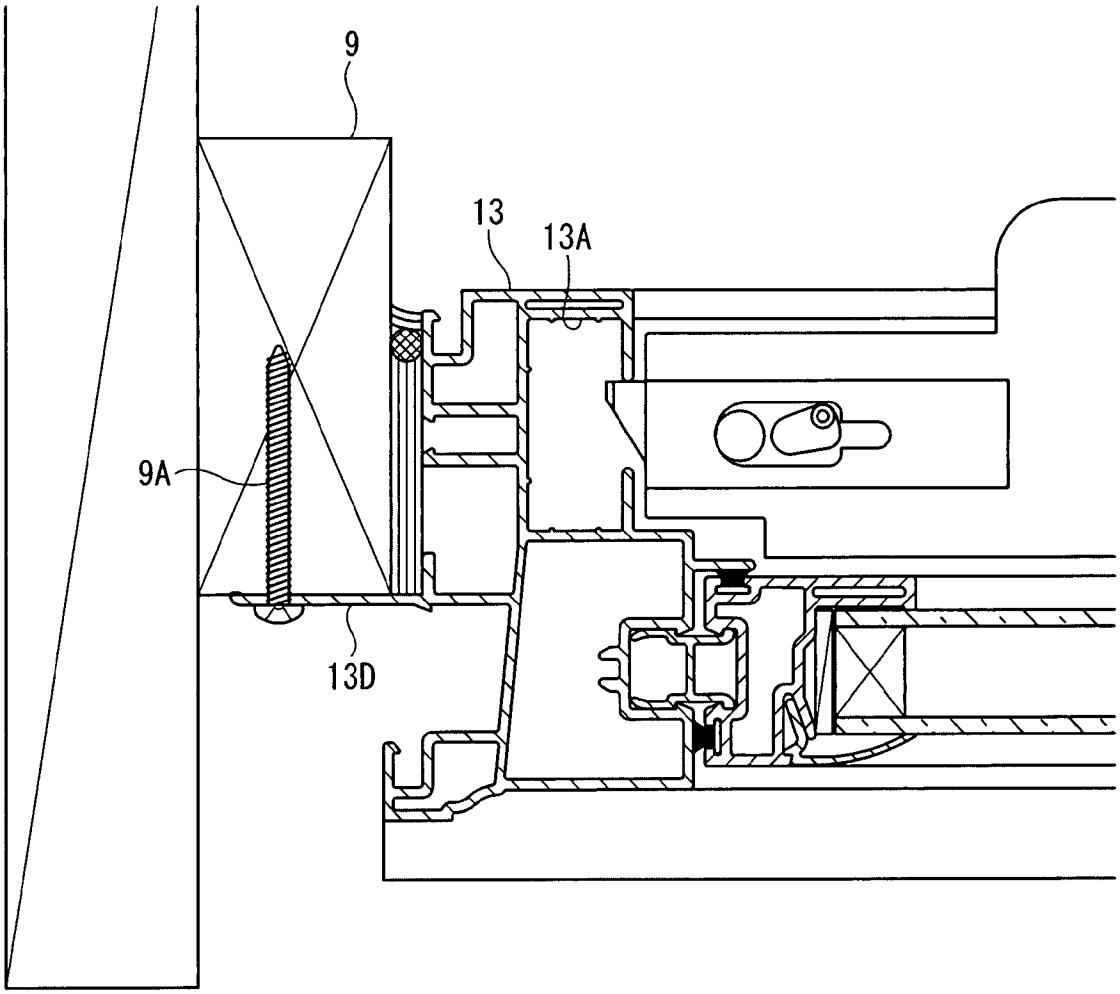
FIG. 6 is a cross-sectional view illustrative of the manner in which the jamb member of the window sash is attached in a depth direction of the sash window.

FIG. 6 shows a jamb member 13 which is essentially the same as those shown in FIGS. 3 and 4 with the exception that an attachment portion or flange 13D is provided for enabling attachment of the jamb member 13 in the depth direction of the window. The attachment flange 13D projects in the width direction and extends over the entire length of the jamb member 13. The attachment flange 13D is secured by screws 9A (only one shown) to a support member 9 to thereby attach the jamb member 13 to the support member 9. The attachment flange 13D may be provided discretely along the length of the jamb member 13. By using the attachment flange 13D, it is possible to attach the jamb member 13 to the support portion 9 in the depth direction of the window. The attachment flange 13D may be cut off or removed in which instance the jamb member 13 may be attached by screws to the support member 9 in the width direction of the window in the same manner as shown in FIG. 5. As a further alternative, the jamb member 13 devoid of the attachment flange 13D may be attached to the support portion 9 by using a base member 19 in the same manner as shown in FIGS. 3 and 4. Because of the groove 13C and attachment flange 13D, the jamb member 13 shown in FIG. 6 is adaptable to various forms of attachment. The same structural features of the jamb member 13 can be also applied to the head member 11 and the sill member 12.

Two jamb members 13, which are disposed intermediately between the outermost jamb members 13 and located at an adjoining area between the two horizontally juxtaposed window frames 10, are identical in structure to the outermost jamb members 13. The intermediate jamb members 13 are connected together back to back via joint members 71, 72, as shown in FIGS. 3 and 4. The connected jamb members 13 form a mullion.

The joint member 71 has opposite side surfaces complementary in contour to the back sides of the respective intermediate jamb members and is connected to the intermediate jamb members 13 via a plurality of tongue-and-groove fitting structures 71A, 71B. The term "tongue-and-groove fitting structure" is used herein in a comprehensive sense, i.e., to broadly refer to fitting structures or joints in which a projecting rib on one of the joint member 71 and each intermediate jamb member 13 fits into a groove in the other of the joint member 71 and the intermediate jamb member 13. The projecting rib may have an enlarged head or a lateral projection that is interlocked with a retaining edge of the groove when the rib and the groove are snap-fit with each other. The joint member 71 is provided with a seal member (weatherstrip) 71C disposed on a central portion of each of the side surfaces thereof for sealing contact with a respective one of the intermediate jamb members 13.

The joint member 72 is connected to an interior side of the joint member 71 via a tongue-and-groove fitting structure 72A so as to cover a joint on the interior side of the two adjoining window frames 10 and 10. On the exterior side of the two adjoining window frames 10, the intermediate jamb members 13, 13 are held in direct abutment with each other.

The single-hung window 1 in the illustrated embodiment takes the form of a dual-type in which two window frames are disposed side by side, however, the sill members 12 are provided one for each of the window frames 10. Thus, the sill members 12 of the single-hung window 1 are separated at a central portion of the single-hung window 1 (i.e., an adjoining area between the two window frames 10). As shown in FIG. 1, the window 1 further has a facing member comprised of a sill nose 80. The sill nose 80 is mounted to extend continuously in a horizontal direction between opposite side ends of the dual-type single-hung window 1 and covers exterior sides of the sill members 12 of the window frames 10, 10. Thus, the sill nose 80 extends between opposite outer side edges of the horizontally juxtaposed window frames 10, 10.

The sill nose 80 is an extruded article of synthetic resin such as PVC, wood, or aluminum alloy, which is the same material as the sill members 12. As shown in FIG. 2, the sill nose 80 is attached to the sill members 12 via a plurality of tongue-and-groove fitting structures 81, 82. The sill nose 80 may be replaced by another sill nose of different design and size provided that the same tongue-and-groove fitting structures are provided. By thus changing the sill nose 80, it is possible to provide each window frame with different design characteristics. Furthermore, it is possible according to the present invention to realize a triple- or multiple-type sash window by merely adding one or more window frames and using a longer sill nose comparable in length to the overall width of the triple- or multiple-type sash window.

As shown in FIG. 1, the opposite ends of the head member 11 of each window frame 10 and upper ends of the jamb members 13 of the same window frame 10 are joined with miters. Stated in other words, the adjacent ends of the head member 11 and each jamb member 13 are cut or beveled at an angle of 45 degrees, and the beveled ends of the head and jamb members 11, 13 are joined by welding to form a miter joint. At the miter joint, the head member 11 and the jamb member 13 have a common cross-sectional shape, so that a sufficiently large structural strength can be obtained. On the other hand, the opposite ends of the sill member 12 of each window frame 10 and lower ends of the jamb members 13 of the same window frame 10 are joined with shoulder miters, which are formed by a combination of a shoulder joint and a miter joint.

Figure 7:
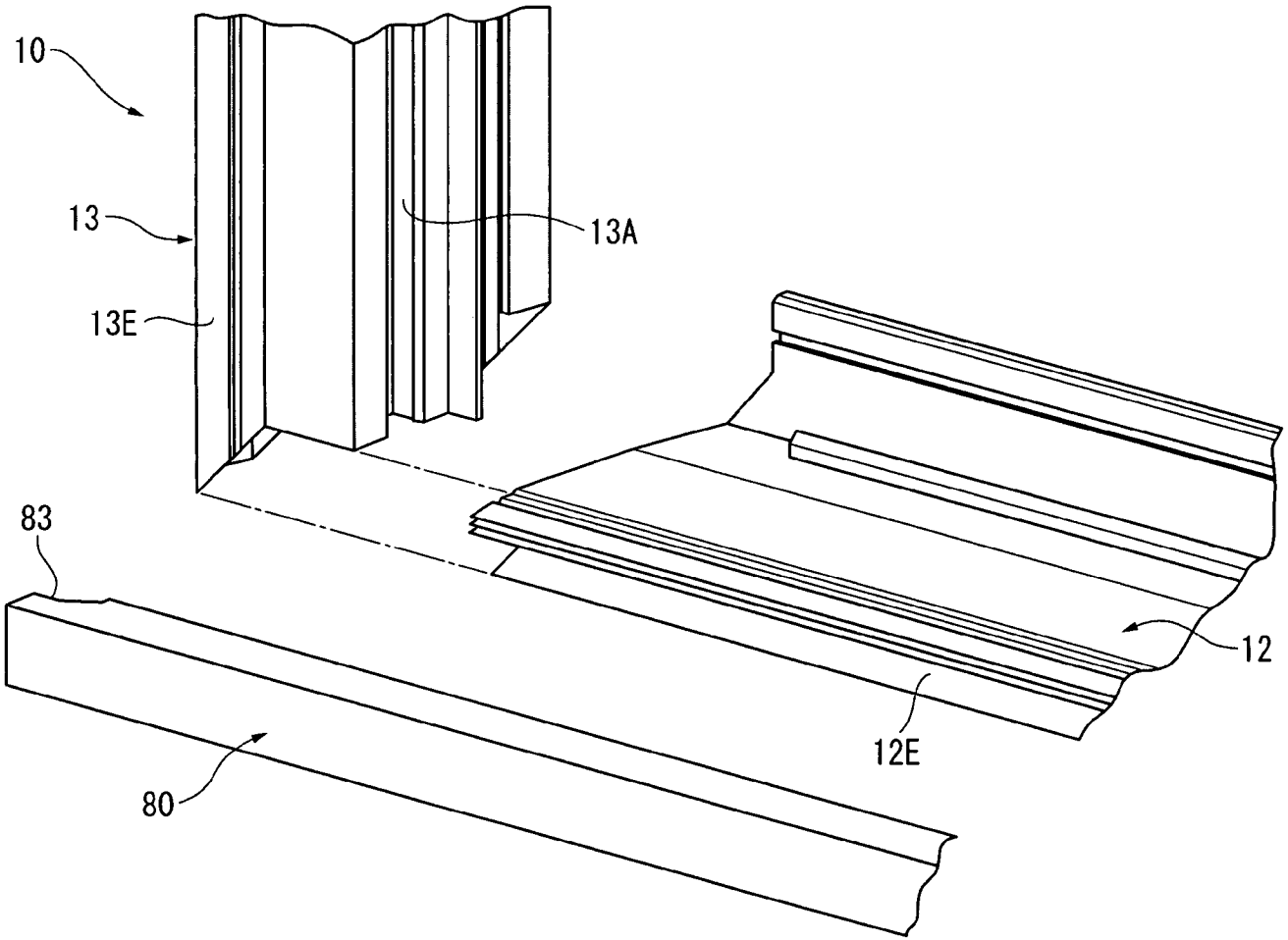
FIG. 7 is an exploded perspective view explanatory of a joint between the jamb member and a sill member of a window frame.

As shown in FIG. 7, an inner side (main part) of the window frame 10, which includes the tracks 13A (one being shown) and is used for mounting of the upper and lower sashes 20 and 30), employs a shoulder joint from an aesthetic point of view as it has a joint surface extending at right angles to a longitudinal axis of the sill or jamb member 12, 13. On the other hand, an outer peripheral side of the window fame 10, which is adjoining a wall surface of the building, employs a miter joint having a joint surface extending obliquely at an angle of 45 degrees with respect to the longitudinal axis of the sill or jamb member 12, 13 for the purpose of providing sufficient strength. Stated more specifically, an inner side (main part) of each end of the sill member 12 is cut at right angles to the longitudinal axis of the sill member 12, and an outer peripheral side 12E of the same end of the sill member 12 is cut obliquely at an angle to 45 degrees relative to the longitudinal axis of the sill member 12. Similarly, a inner side (main part) of the lower end of the jam member 13 is cut at right angles to the longitudinal axis of the jamb member 13, and an outer peripheral side 13E of the lower end of the jamb member 13 is cut obliquely at an angle of 45 degrees relative to the longitudinal axis of the jamb member 13. The cut ends of the sill member 12 and jamb member 13 are mated and welded together to thereby form a shoulder miter joint.

The miter joint part (lower part) of the shoulder miter joint is covered by the sill nose 80. The sill nose 80 has a cutout recess 83 for accommodating the outer peripheral side of the jamb 13 so that the sill nose 80 is in close contact with the sill member and the jamb member 13. The sill nose 80 conceals the miter joint part of the shoulder miter joint from view.

As previously described with reference to FIG. 2, each of the movable lower sashes 30 has a crescent lock 35 provided on the top rail 31 thereof, and the crescent lock 35 projects upwards from the top rail 31. This means that when the lower sash 30 is fully opened or lifted up to an uppermost position, the crescent lock 35 interferes with the head member 11, thereby preventing further upward movement of the lower sash 30 even through the top rail 31 of the lower sash 30 is spaced a distance from the head member 11. This limits an opening area of the window provided when the lower sash 30 is fully opened.

Figure 8:
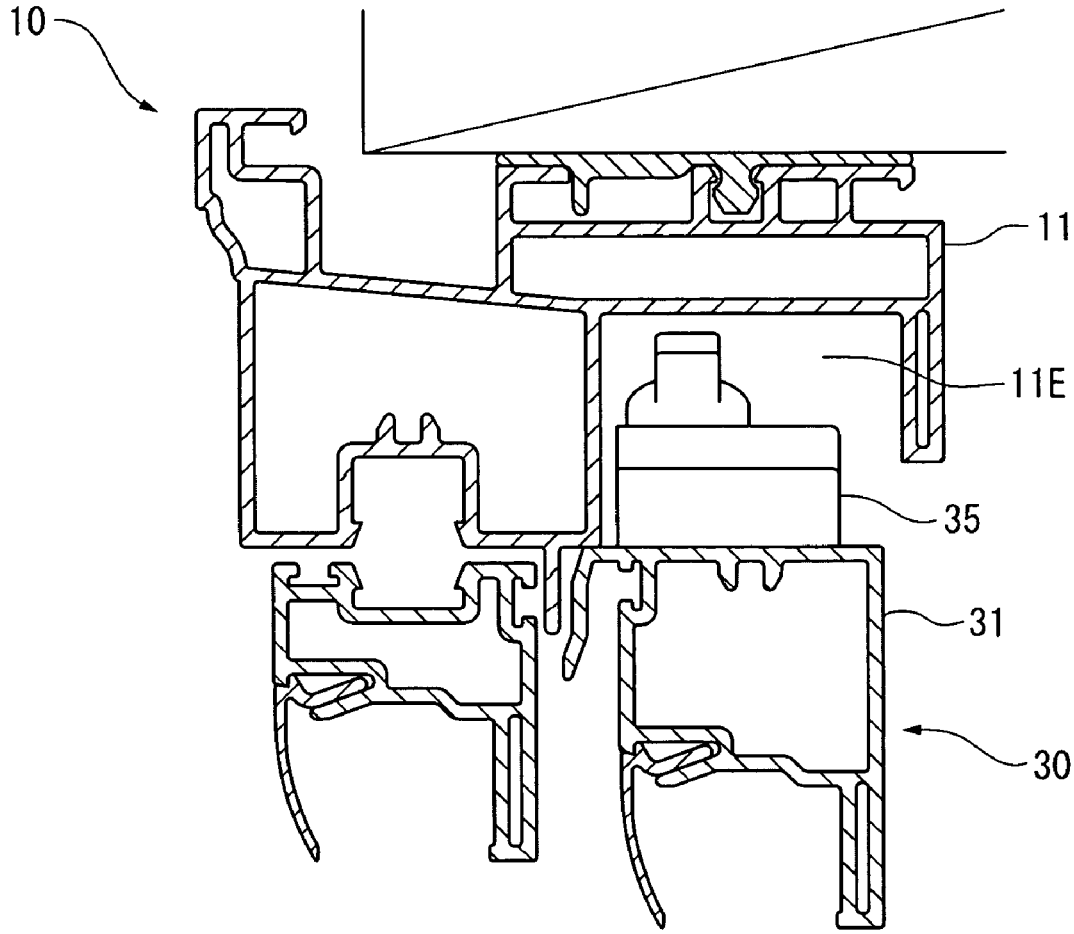
FIG. 8 is a cross-sectional view showing a recessed portion formed in a head member of the sash window.

To deal with this problem, the head member 11, as shown in FIG. 8, has a recessed portion 11E formed in an under surface thereof for accommodating the crescent lock 35 when the lower sash 30 is in its fully open position. By providing the recessed portion 11E in the head member 11, it is possible to open the lower sash 30 until the top rail 31 of the lower sash 30 comes in contact with the head member 11 with the crescent lock 35 fully received in the recessed portion 11E. Thus, the area of an opening provided when the lower sash 30 is fully opened is enlarged.

Each of the fixed upper sashes 20 is supported within respective one of the window frames 10 in vertically spaced relation to the sill member 12 so as to close an upper half of an opening defined by the window frame 10. To achieve such supporting, a pair of attachment members (sash bracket) 90 is incorporated in the jamb members 13, respectively, of each window frame 10 for supporting the upper sash 20 at opposite lower ends thereof.

Figure 9:
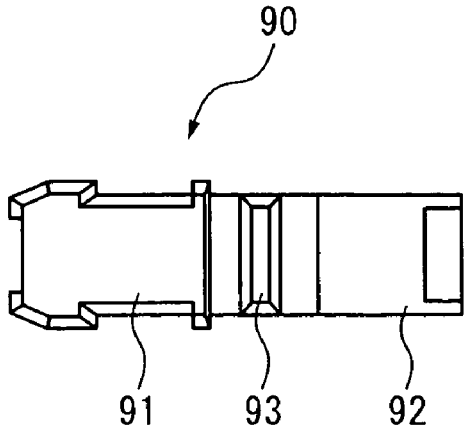
FIG. 9 is a plan view of a sash bracket used in the sash window.
Figure 10:
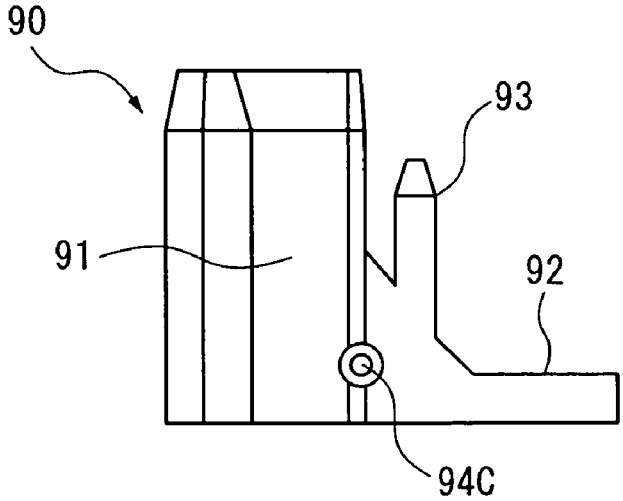
FIG. 10 is a side view of the sash bracket.
Figure 11:
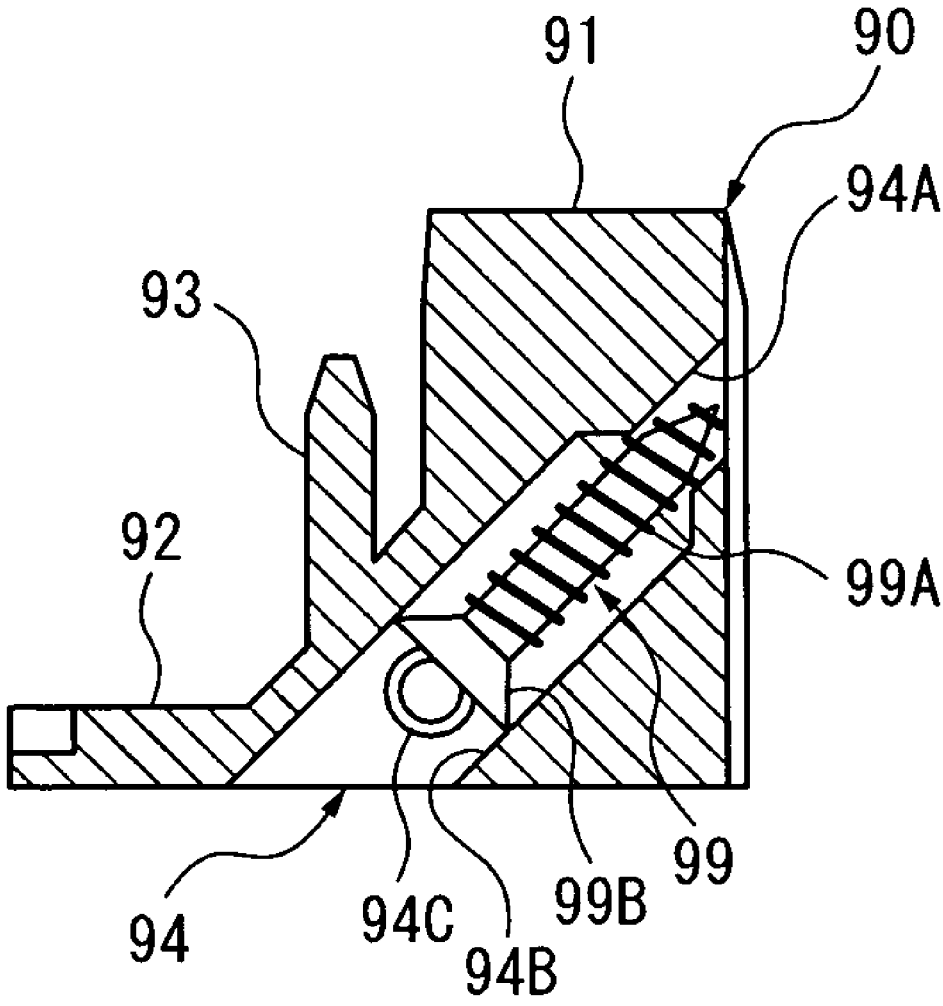
FIG. 11 is a cross-sectional view of the sash bracket.

As shown in FIGS. 9 and 10, each of the attachment members (sash brackets) 90 includes a bracket body 91 of quadrangular prismatic shape, an arm 92 projecting from a lower end of one side surface of the quadrangular prismatic bracket body 91 in a horizontal direction, and a locking prong 93 projecting upward from a proximal end portion of the arm 92 and parallel spaced from the rectangular body 91 by a distance substantially equal to a thickness of a portion of the upper sash 20 to be retained by the attachment member 90. Thus, respective parts of the body 91, arm 92 and locking prong 93, which jointly form a groove in which the sash portion is retained, constitute a retaining portion. As shown in FIG. 11, the attachment member 90 further has a through-hole 94 extending obliquely at an angle of 45 degrees from a lower surface of the arm 92 to an opposite side surface of the quadrangular prismatic bracket body 91 for the passage therethrough of a threaded shank 99A of an attachment screw 99. The lower surface of the arm 92 is disposed on a side opposite to the retaining portion.

The through-hole 94 is a stepped hole including a small-diameter portion 94A and a large-diameter portion 94B separated by a step. The small-diameter portion 94A opens at the side surface of the quadrangular prismatic bracket body 91 and has an inside diameter which is larger than an outside diameter of the threaded shank 99A of the attachment screw 99 and smaller than a minimum outside diameter of an enlarged head 99B of the attachment screw 99. The large-diameter portion 94B opens to the lower surface of the arm 92 and has an inside diameter larger than a maximum outside diameter of the enlarged head 99B of the attachment screw 99. The attachment member 90 further has a retainer projection 94C formed on a circumferential surface of the large-diameter portion 94B of the stepped through-hole 94. The retainer projection 94C is formed by punching a corresponding part of the attachment member from outside to the extent that a distance between the retainer projection and a portion of the circumferential surface of the large-diameter portion 94B which is diametrically opposite to the retainer projection 94C is smaller than the minimum outside diameter of the enlarged head 99B of the attachment screw 99. The punching process to form the retainer projection is effected under conditions that the attachment screw 99 is received in the stepped through-hole 94 with the enlarged head 99B displaced from a predetermined punching position on the attachment member 90 toward the small-diameter portion 94A. After the punching process, the attachment screw 99 is automatically retained within the through-hole 94 through interference engagement with the retainer projection 94C.

Figure 12:
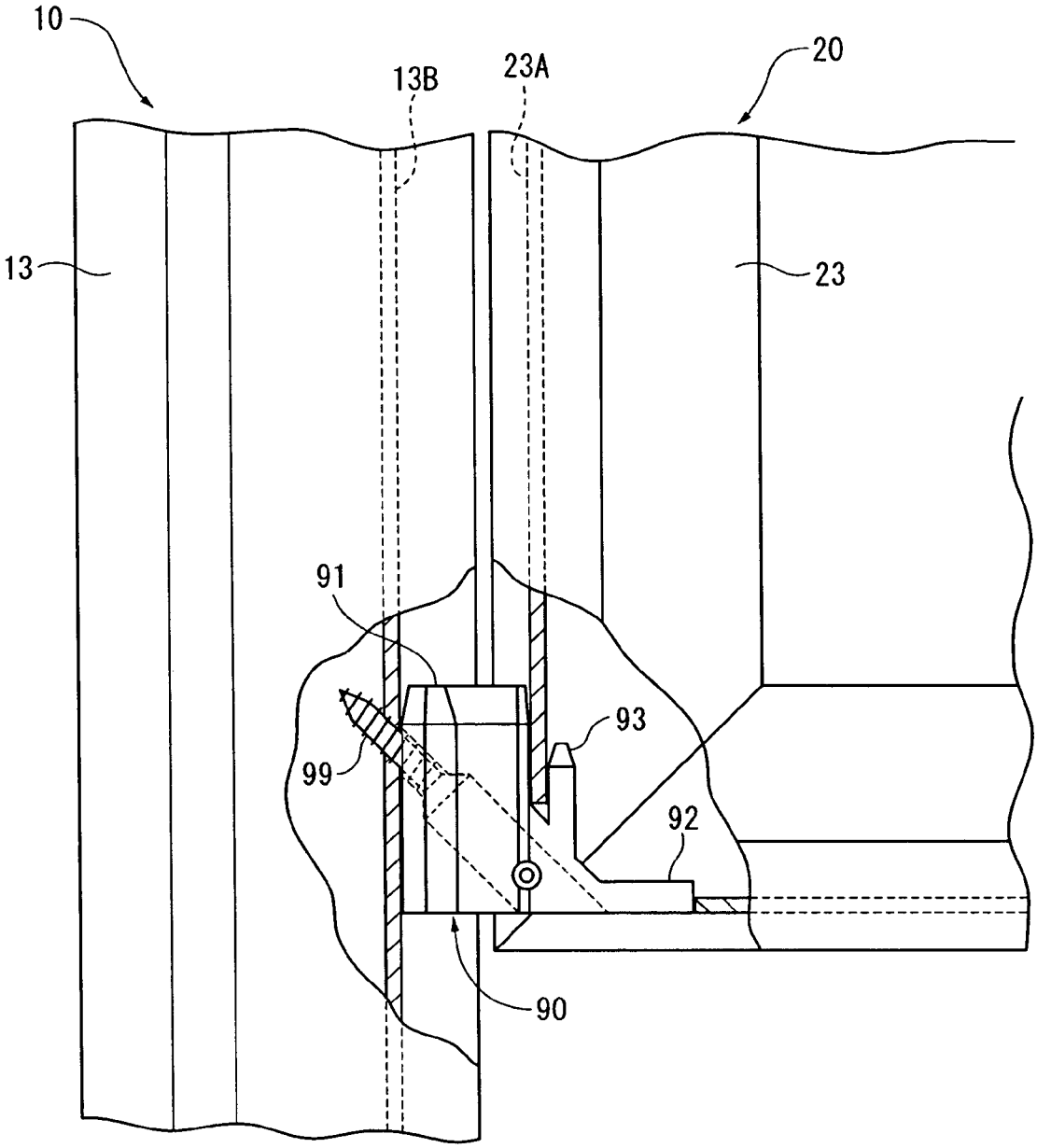
FIG. 12 is an enlarged front elevational view, with parts cutaway for clarity, of a part of the sash window showing the manner in which a movable sash is attached to the window frame.

The attachment member (sash bracket) 90 of the foregoing construction is fitted on each of lower end corners of respective one of the upper sashes 20 and attached to an adjacent one of the jamb members 13 to thereby secure the upper sash 20 in position within the window frame 10. To this end, as shown in FIG. 12, the lower end corner of the upper sash 20 is cutout so that the longitudinal recessed portion 23A of each side rail 23 has a lower end upwardly separated from a mating end of the recessed portion (not designated) of the bottom rail 22 and exposed to view from below the upper sash 20. The upper sash 20 is held at a desired height within the window frame 10, and while keeping this condition, the locking prong 93 of the attachment member (sash bracket) 90 is fitted with a lower end edge of a bottom wall of the recessed portion 23A, and subsequently the attachment member 90 is forced upward so that the bracket body 91 is received in the recessed portion 13B of the jamb member 13 and the lower end portion of the bottom wall of the recessed portion 23A is retained in a space defined between the bracket body 91 and the locking prong 93. Thereafter, a screwdriver (now shown) inserted into the through-hole 94 from below is rotated in a screw-tightening direction, so that the attachment screw 99 is threaded into a bottom wall of the recessed portion 13B. The upper sash 20 is thus secured to an upper portion of the window frame 10.

By using the attachment member 90, the screw-tightening operation is achieved from a diagonal direction, which will increase the efficiency of a sash mounting work or operation. Furthermore, since the attachment screw 99 is accommodated in advance within the attachment member 90 and kept free from removal or omission, the sash mounting operation can be achieved with high efficiencies.

The present invention should not be limited to the embodiment described above. Rather, various changes and modifications are possible for each structural part of the present invention. Furthermore, the base member 19, joint members 71, 72, sill nose 80 and attachment member 90 may be incorporated in other window frames than the window frame 10 in the illustrated embodiment. For instance, these members can be also effectively applied to horizontal sliding windows, fixed windows or the like.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

What is claimed is:

1. A sash window assembly comprising:

a window frame including a head member, a sill member and a pair of jamb members connected together into a rectangular configuration;

an upper sash and a lower sash each having a sash frame including a top rail, a bottom rail and a pair of side rails connected together into a rectangular configuration, and a panel member disposed within the sash frame; and wherein said upper sash is a fixed sash, and the sash window assembly further comprises a pair of attachment members disposed inside opposite lower corner portions of the upper sash fixedly securing the upper sash to the window frame, and each of the attachment members includes a generally rectangular body having one surface facing a respective one of the jamb members, a retaining portion retaining a part of the upper sash, a through-hole extending from a side of said body opposite to the retaining portion to the one surface of the body, and an attachment screw received in the through-hole and threaded into the respective one of the jamb members, each said through-hole being partially disposed within said upper sash and extending diagonally with respect to longitudinal axis of said respective one of the jamb members.

2. The sash window assembly according to claim 1, wherein at least one of the head member, the sill member and the pair of jamb members includes a first attachment portion adapted to attach the window frame to a building wall, and a second attachment portion adapted to attach the window frame to the building wall, the first attachment portion and the second attachment portion being used selectively to attach the window frame to the building wall.

3. The sash window assembly according to claim 1, wherein the head member, the sill and the pair of jamb members are adapted to be supported on a head support portion, a sill support portion, and a pair of jamb support portions, respectively, of a building, at least one of the head member, the sill and the pair of jamb members includes a base member adapted to be secured to a corresponding one of the support portions.

4. The sash window assembly according to claim 3 wherein the base member is adapted to be secured to the corresponding one of the support portions by one of nailing, screw clamping, caulking, adhesive bonding, pressure-sensitive adhesion, welding and a combination thereof, and the at least one of the head member, the sill and the pair of jamb members and the base member are detachably connected together via a tongue-and-groove fining structure.

5. The sash window assembly according to claim 1, wherein the lower sash is slidably movable along the pair of jamb members, the lower sash has a lock device disposed on the top rail of the lower sash for locking the lower sash in position against movement relative to the upper sash, and the window frame has a recessed portion formed in the head member the recessed portion accommodating the lock device when the lower sash is moved upwardly into a fully open position, wherein the fully open position comprises an uppermost portion of the top rail of the lower sash being disposed vertically higher than an uppermost portion of the top rail of the upper sash.

6. The sash window assembly according to claim 1, wherein the through-hole is a stepped hole including a small-diameter portion having an inside diameter having a size to allow passage of a shank of the attachment screw but blocking passage of a head of the attachment screw, and a large-diameter portion having an inside diameter having a size to accommodate therein the head of the attachment screw, the large-diameter portion including a retainer projection projecting from an inner surface of the large-diameter portion to retain the attachment screw within the through-hole.

7. The sash window assembly according to claim 1 further comprising a facing member covering an exterior side of the sill member and extending horizontally between the jamb members.

8. The sash window assembly according to claim 7, wherein each joint between the sill member and each of the jamb members at least partly includes a miter joint, and the facing member covers at least part of both of the miter joints.

9. The sash window assembly according to claim 7, wherein the window frame comprises a plurality of window frames disposed in horizontal juxtaposition with respect to each other, and the facing member is configured to extend continuously over the horizontally juxtaposed window frames.

10. The sash window assembly according to claim 7, wherein the facing member is attached to the sill member via at least one tongue-and-groove fitting structure.

11. The sash window assembly according to claim 1 further comprising an elongated member having an H-shaped cross-sectional shape taken perpendicularly to a longitudinal axis of the elongated member, wherein the head member of the window frame defines a first elongated recessed portion along a surface thereof, the top rail of the upper sash defines a second elongated recessed portion along a surface thereof, wherein the surface of the head member cofaces and is spaced apart from the surface of the upper sash when the upper sash is disposed within the window frame, a first portion of the elongated member is disposed within the first elongated recessed portion and a second portion of the elongated member is disposed within the second elongated recessed portion, the first portion being disposed vertically above the second portion.

* * * * *